US007123863B2

(12) United States Patent
Yamada et al.

(10) Patent No.: US 7,123,863 B2
(45) Date of Patent: Oct. 17, 2006

(54) IMAGE FORMING APPARATUS WITH ROTARY UNIT THAT CAN ACCOMMODATE A PLURALITY OF DEVELOPMENT CARTRIDGES

(75) Inventors: Yoichi Yamada, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/078,659

(22) Filed: Mar. 10, 2005

(65) Prior Publication Data

US 2006/0210314 A1 Sep. 21, 2006

(30) Foreign Application Priority Data

| | | |
|---|---|---|
| Mar. 10, 2004 | (JP) | P2004-067238 |
| Mar. 10, 2004 | (JP) | P2004-067239 |
| Mar. 8, 2005 | (JP) | P2005-063569 |
| Mar. 8, 2005 | (JP) | P2005-063570 |

(51) Int. Cl.
*G03G 15/00* (2006.01)

(52) U.S. Cl. ..... 399/227

(58) Field of Classification Search ..... None
See application file for complete search history.

(56) References Cited

FOREIGN PATENT DOCUMENTS

| | | |
|---|---|---|
| JP | 11-065218 | 3/1999 |
| JP | 2000-172035 | 6/2000 |
| JP | 2000-242067 | 9/2000 |
| JP | 2002-351190 | 12/2002 |
| JP | 2003-233238 | 8/2003 |
| JP | 2003-255662 | 9/2003 |
| JP | 2003-316106 | 11/2003 |

*Primary Examiner*—Quana Grainger
(74) *Attorney, Agent, or Firm*—Hogan & Hartson LLP

(57) ABSTRACT

A development rotary unit is made loadable with a development cartridge having no conditioning fin and containing a black toner in addition to a development cartridge containing a black toner and having a conditioning fin for agitating and re-supplying the toner contained therein. In the case of formation of an image which necessitates an operation of re-supplying a toner by rotating the development rotary unit in order to form it with the development cartridge, the formation of the image is started by moving the development cartridge to the developing position.

7 Claims, 10 Drawing Sheets

IMAGE FORMING APPARATUS WITH ROTARY UNIT THAT CAN ACCOMMODATE A PLURALITY OF DEVELOPMENT CARTRIDGES

BACKGROUND OF THE INVENTION

1. Field of the Invention

The invention relates to image forming apparatus and, more particularly, to an apparatus which can be used as a machine dedicated to the formation of a single-color image by allowing a plurality of development cartridges containing toners in the same color to be mounted in place of development cartridges containing toners for forming a color image.

2. Description of the Related Art

Image forming apparatus employing an electrophotographic recording method have been known, in which an electrostatic latent image is exposed on a surface of a carrying member fabricated from a photosensitive material. In such image forming apparatus, a toner image developed from such an electrostatic latent image using toners and carried on a surface of the carrying member is transferred onto a recording medium such as recording paper to form an image. The electrostatic latent image is developed using a toner by rotating a development roller facing the surface of the carrying member to cause a toner on a surface of the roller to transfer and stick to the carrying member. The toner is supplied to the development roller from a supply roller which is pressed against the development roller while rotating in a toner containing space.

Image forming apparatus employing the electrophotographic recording method include apparatus configured to accommodate a plurality of development cartridges in a rotary unit, the cartridges having a development roller which faces a carrying member and a container which contains a supply roller and a toner. In such an image forming apparatus, a development cartridge in a developing position facing the carrying member can be switched to another by rotating the rotary unit around a rotary shaft.

Therefore, when such an image forming apparatus is configured to allow development cartridges containing toners in yellow (Y), magenta (M), cyan (C), and black (K), respectively, to be accommodated (mounted) in the rotary unit as development cartridges for applying toner on a surface of a carrying member, a color image can be formed by switching the development cartridges sequentially to apply the colors one over another.

In the case of such an electrophotographic recording type image forming apparatus, there is a need for refreshing the toners in the containers by agitating the same to maintain image quality. Therefore, some image forming apparatus with a rotary unit have a configuration in which the toners in the containers can be temporarily agitated to be refreshed by rotating the rotary unit to turn the development cartridges upside down after a predetermined amount of image is formed.

Specifically, in such an image forming apparatus, the development cartridges are sequentially switched to form a color image. Therefore, image quality can be maintained as occasions demand by refreshing the developing toners concurrently with an operation of switching development cartridges in which the rotary unit is rotated to cause a development roller to face the carrying member.

However, when a single-color image is formed, one development cartridge is continuously used, and the operation of causing one rotation of the rotary unit may be required during the continuous image forming operation (developing operation). Since the operation of causing one rotation of the rotary unit takes time and can interrupt an image forming operation, an agitator may be provided in a development cartridge to refresh a toner therein by agitating (conditioning) it. However, when such an agitator is also provided in development cartridges containing toners which are less frequently used for forming single-color images, there will be a wasteful cost increase. For this reason, there are suggestions for the provision of an agitator only in a development cartridge containing a toner in black (K) which is frequently used for forming single-color images such as documents (see JP-A-2003-255662 for example).

In some image forming apparatus having a rotary unit, a partition plate is provided in a development cartridge (container) to define a small space in which a supply roller is to be rotated, and the development cartridge is turned upside down after a predetermined amount of image is formed to perform an operation of temporarily agitating (refreshing) the toner in the container and replenishing (conditioning) the space in which the supply roller rotates with the toner.

In such an image forming apparatus, when a color image is formed, development cartridges are sequentially switched, and the operation of replenishing the spaces in which the supply rollers rotate with toners is performed concurrently with a development cartridge switching operation even before the toner in any of the development cartridges runs out.

Under the circumstance, even for such a development cartridge having a partition plate, there is a need for providing a replenishing device for replenishing the supply roller with the toner without relying on the rotation of the cartridge when the development cartridge is frequently used for forming single-color images.

There are suggestions on configurations to allow a plurality of development cartridges containing toners in the same color (which is black in most cases) to be mounted in such an image forming apparatus having such a rotary unit. In such configurations, the rotary unit is rotated to switch the development cartridges sequentially each time the toner in the cartridge in use runs out, which makes it possible to continue the formation of single-color images for a long time while reducing the number of times of an operation of replacing the development cartridges to replenish the apparatus with the toner (see JP-A-2002-351190 and JP-A-2003-316106, for example).

However, in the case of an image forming apparatus in which only development cartridges containing a toner for single-color images incorporate a device for a conditioning operation to agitate and re-supply the toner contained therein, when development cartridges containing toners in the same color are to be mounted in all housing positions, ease of use is reduced if there are restrictions on the housing positions for the development cartridges depending on whether they have an agitator or not. On the other hand, when all of the development cartridges containing the toners in the same color are equipped with an agitator, the amount of the toner contained is reduced because the spaces to contain the toner include the members some of which cannot be operated.

SUMMARY OF THE INVENTION

Under the circumstance, it is an object of the invention to provide an image forming apparatus configured to be loadable with both of a development cartridge requiring a rotation of a rotary unit for the agitation of a toner contained therein and a development cartridge having no need for such rotation of the rotary unit, in which development cartridges containing toners in the same color can be mounted to improve ease of use.

(1) As a solution to the problem, in a first aspect of the invention, there is provided an image forming apparatus comprising a carrying member for carrying a toner image provided by forming an electrostatic latent image on a surface thereof and developing the electrostatic latent image; a plurality of development cartridges for forming the toner image that is to be transferred onto a surface of a recording medium by applying a toner to the electrostatic latent image on the surface of the carrying member to develop the image; a rotary unit which accommodates the plurality of development cartridges around a rotary shaft and rotates around the rotary shaft to cause any of the development cartridges to face the surface of the carrying member; and a control unit which controls the rotation of the rotary unit and the driving of the development cartridges to form the toner image. The rotary unit is configured to accommodate development cartridges containing toners in different colors to allow formation of a color image, multi-color image, or single-color image. A conditioner is disposed only in a development cartridge containing a toner in a color for forming a single-color image to condition the toner contained therein so as to allow continuous formation of an image. The operation of conditioning the contained toner is performed with the toner contained in the other development cartridges turned upside down as a result of a rotation of the rotary unit during the formation of the image. The invention is characterized in that toners in the same color as that in the development cartridge having the conditioner is contained in a development cartridge without the conditioner and in that the development cartridge can be accommodated in a respective accommodating position in the rotary unit.

According to the invention, the toner for a single color-image can be accommodated also in the development cartridge without the conditioner that is mounted in an accommodating position of the rotary unit where the conditioner cannot be operated, thereby allowing the cartridge to continue the formation of the single-color image. Therefore, a greater number of development cartridges for a single-color image can be accommodated (mounted). Since the development cartridge does not incorporate the conditioner, it can contain a greater amount of the toner for a single-color image than the development cartridge having the conditioner.

(2) An image forming apparatus in a second aspect of the invention is characterized in that the development cartridge having the conditioner can be accommodated in the accommodating position of the rotary unit for the development cartridge without the conditioner.

According to the invention, a single-color image can be continuously formed even when a plurality of the development cartridges having the conditioner are mounted in accommodating positions of the rotary unit where the conditioner can not be operated. This similarly allows a greater number of development cartridges for a single-color image to be accommodated.

(3) An image forming apparatus in a third aspect of the invention is characterized in that it comprises an identification unit for identifying a development-cartridge accommodated in the rotary unit and in that the control unit controls the rotating operation of the rotary unit based on information from the identification unit.

According to the invention, a development cartridge mounted is identified, and the rotary unit is rotated as occasion demands depending on which of a color image or single-color image the cartridge serves and whether it has the conditioner or not. Therefore, an image forming operation can be performed as desired without a need for any setting operation at the time of the mounting of the development cartridge.

(4) An image forming apparatus in a fourth aspect of the invention is characterized in that, when a plurality of development cartridges containing toners in the same color are accommodated in the rotary unit and when the formation of an image necessitates an operation of conditioning the toners contained in the development cartridges, the control unit starts the image forming operation with a development cartridge having the conditioner located in a developing position facing the surface of the carrying member.

According to the invention, when it is found that a plurality of development cartridges containing toners in the same color have been mounted, if an image forming operation is performed to continuously form single-color images in an amount which necessitates an operation of conditioning the contained toners, the image forming operation is started with a development cartridge having the conditioner located in the developing position. It is therefore possible to avoid a situation in which a rotation of the rotary unit is required because of the absence of the conditioner when a need for the adjustment of the contained toner arises as the image formation continues. When an image forming operation is performed in an amount which does not necessitate the toner conditioning operation, the presence or absence of the conditioner does not matter.

The conditioner is a device which allows a toner contained to be conditioned in a way similar to that achieved by rotating the rotary unit. For example, the conditioner agitates a toner to be supplied to a development roller and supplies the toner to the development roller.

(5) In a fifth aspect of the invention, there is provided an image forming apparatus comprising a bearing member for bearing a toner image provided by forming an electrostatic latent image on a surface thereof and developing the electrostatic latent image; a plurality of development cartridges for forming the toner image that is to be transferred onto a surface of a recording medium by applying a toner to the electrostatic latent image on the surface of the bearing member to develop the image; a rotary unit which accommodates the plurality of development cartridges around a rotating shaft and rotates about the rotating shaft to cause any of the development cartridges to face the surface of the bearing member; and control means which controls the rotation of the rotary unit and the driving of the development cartridges to form the toner image. The rotary unit is configured to accommodate development cartridges containing toners in different colors to allow formation of a color image, multi-color image, or single-color image. Conditioner is disposed only in a development cartridge containing a toner in a color for forming a single-color image to condition the toner contained therein so as to allow continuous formation of an image. The operation of conditioning the contained toner is performed with the toner contained in the other development cartridges turned upside down as a result of a rotation of the rotary unit during the formation of the image. The invention is characterized in that a development cartridge without the conditioner can be accommodated in the position to accommodate the development cartridge having the conditioner.

According to the invention, a development cartridge to be mounted in an accommodating position where the conditioner cannot be operated is made commonly usable, i.e., made mountable in an accommodating position of the rotary unit where the conditioner can be operated. Therefore, a single-color image can be continuously formed by switching such development cartridges containing toners in the same color, and a greater number of development cartridges for a single-color image can be accommodated (mounted). Since the development cartridge does not incorporate the conditioner, it can contain a greater amount of toner than the development cartridge having the conditioner.

(6) An image forming apparatus in a sixth aspect of the invention is characterized in that development cartridges without the conditioner containing toners in the same color can be accommodated in all accommodating positions.

According to the invention, development cartridges without the conditioner containing toners in the same color can be mounted in all accommodating position of the rotary unit including an accommodating position where the conditioner can be operated. Therefore, the apparatus can be used as a dedicated machine capable of forming a large amount of single-color images. In such a case, a development cartridge can be quickly switched to another cartridge adjacent thereto, which allows an image forming operation to be continued in a comfortable manner.

(7) An image forming apparatus in a seven aspect of the invention is characterized in that it comprises an identification unit for identifying a development cartridge accommodated in the rotary unit and in that the control means controls the rotating operation of the rotary unit based on information from the identification unit.

According to the invention, a development cartridge mounted is identified, and the rotary unit is rotated as occasion demands depending on which of a color image or single-color image the cartridge serves and whether it has the conditioner or not. Therefore, an image forming operation can be performed as desired without a need for any setting operation at the time of the mounting of the development cartridge.

(8) An image forming apparatus in an eighth aspect of the invention is characterized in that, when a plurality of development cartridges without the conditioner containing toners in the same color are accommodated in the rotary unit and when the formation of an image necessitates an operation of conditioning the toners contained in the development cartridges, the control means causes a rotation of the rotary unit to condition the toners contained.

According to the invention, when it is found that a plurality of development cartridges for single-color images without the conditioner containing toners in the same color have been mounted, if an image forming operation is performed to continuously form single-color images in an amount which necessitates an operation of conditioning the contained toners, the image forming operation is performed by rotating the rotary unit as occasions demand. It is therefore possible to form single-color images continuously when a plurality of development cartridges containing toners in the same color, without a need for control to use them differently depending on whether there is the conditioner or not.

The conditioner is a device which allows a toner contained to be conditioned in a way similar to that achieved by rotating the rotary unit. For example, the conditioner agitates a toner to be supplied to a development roller and supplies the toner to the development roller.

According to the invention, development cartridges having no conditioner and containing toners in the same color (toners for single-color images) can be mounted in all or some of accommodating position of the rotary unit. It is therefore possible to form a greater amount of single-color images while reducing the number of replacing operations performed to replenish development cartridges compared to a case in which only one development cartridge for single-color images is mounted.

The rotary unit is rotated as occasions demand based on identification of development cartridges such as the colors of toners contained therein and the number of the cartridges. Since it is therefore possible to form a color image or single-color image continuously without a need for any special setting according to the type of development cartridges mounted, there will be no increase in operational burdens on an operator. For example, when an image forming operation necessitating the operation of conditioning contained toners is to be performed, the image formation can be achieved through rotations of the rotary unit which also allow the toners contained to be conditioned.

Therefore, a user may prepare and mount development cartridges for better operability considering, for example, which of single-color images and color images will be more frequently formed, and this allows improvement in ease of use.

BRIEF DESCRIPTION OF THE DRAWINGS

FIG. 4A is a side view showing a state of the same on the way of insertion or removal, and FIG. 4B is a side view showing a mounted state of the same;

DETAILED DESCRIPTION OF THE PREFERRED EMBODIMENTS

First Embodiment

An embodiment of the invention will now be described with reference to the drawings. FIGS. 1 to 8 show an embodiment of an image forming apparatus according to the invention.

Figure 1:
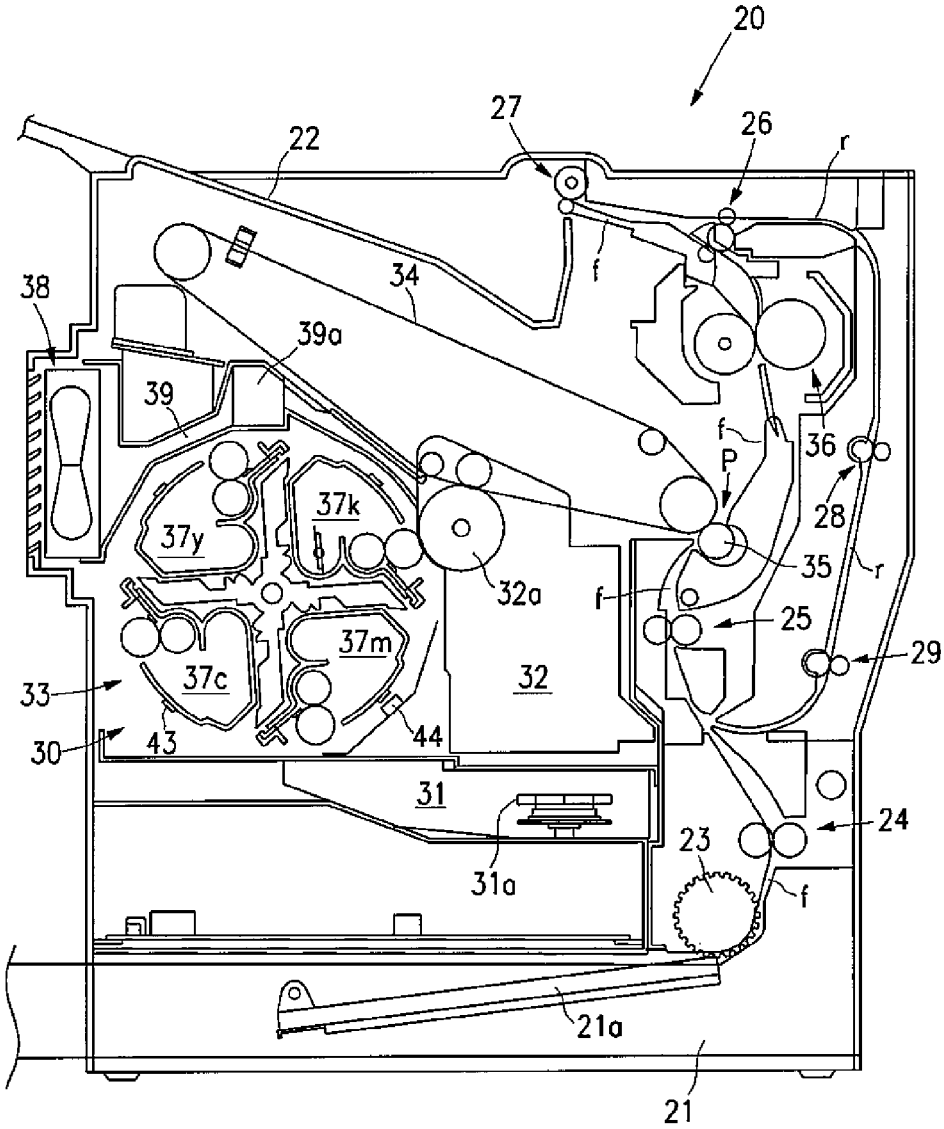
FIG. 1 is a perspective front view of a first embodiment of an image forming apparatus according to the invention schematically showing a general configuration of the same.
Figure 2:
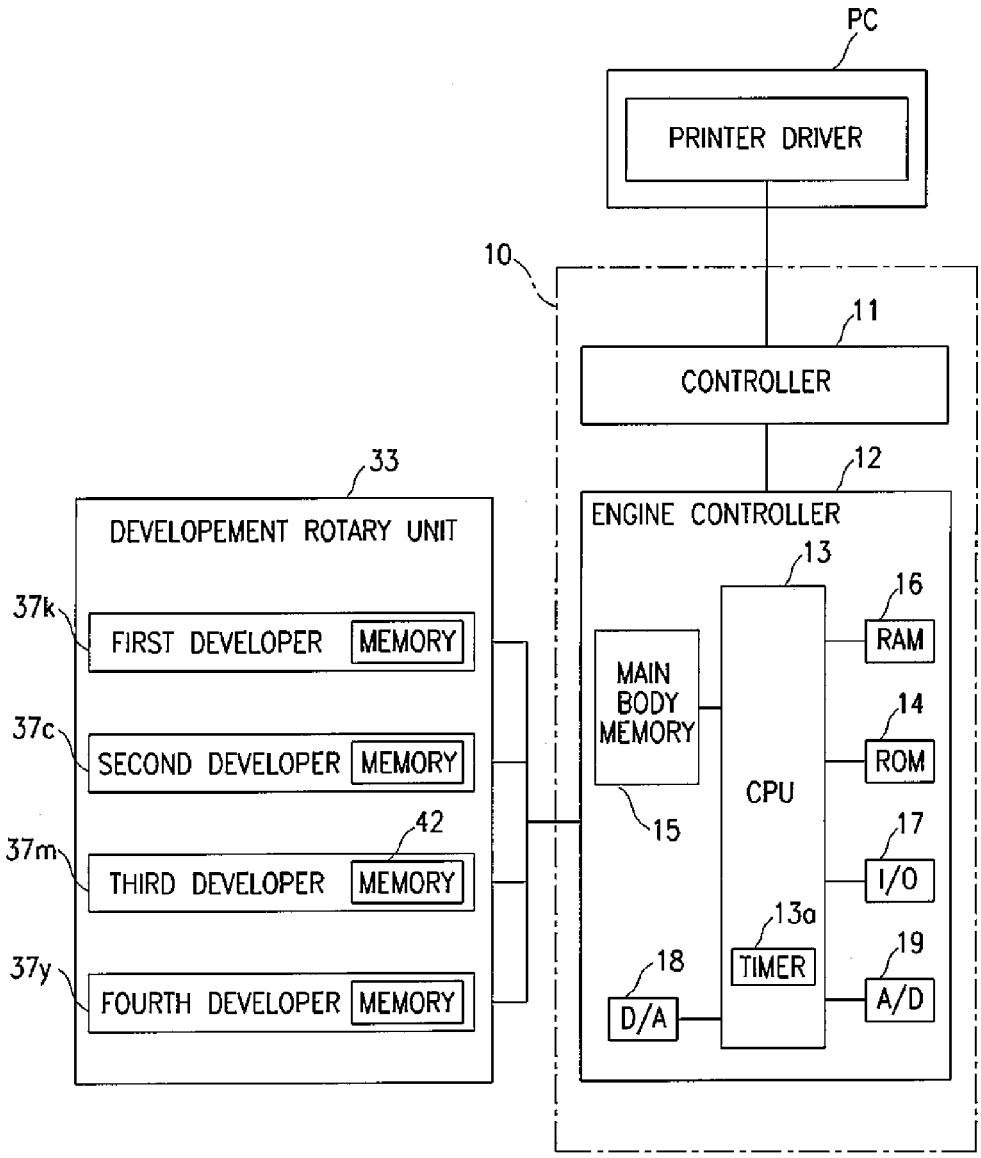
FIG. 2 is a relational block diagram for explaining drive control performed in the apparatus.

Referring to FIGS. 1 and 2, the image forming apparatus is used by connecting it to, for example, a personal computer PC to create and output images such as characters. A control unit 10 connected to the personal computer PC governs and controls a sheet feeder 20 and an image recorder 30 to form and print an image on recording paper (recording medium).

The control unit 10 comprises a controller 11 and an engine controller 12 constructed on a circuit board which is mounted in a main body of the apparatus, and the controllers control processing of various data and control driving of various parts of the apparatus according to programs which are prepared in advance.

Briefly, a CPU (not shown) executes various processing steps according to processing programs stored in a memory, and the controller 11 thus exchanges various types of information such as an instruction for printing with a printer driver in the personal computer PC, receives image data such as a text whose image is to be formed by printing it on recording paper, and temporarily stores the data in a memory which is not shown.

Since the image data (image information signals) received from the personal computer PC are so-called RGB data consisting of red (R), green (G), and blue (B) data, the controller 11 reads the data from the memory while converting them into so-called YMCK image data consisting of yellow (Y), magenta (M), cyan (C), and black (K) data which can be printed and passes the data to the engine controller 12.

In the engine controller 12, a CPU 13 receives the image data, for example, on a page-by-page basis from the controller 11 and temporarily stores them in a memory 15 in the main body according to a control program stored in a ROM 14. The CPU also exchanges various types of information with the sheet feeder 20 and the image recorder 30 while using a RAM 16 as a work area, thereby forming an image on the recording paper based on the image data. When the CPU 13 executes control over the image formation, it measures various processing times using a timer function (time-measuring means) 13*a* incorporated therein to optimize operations of various parts of the apparatus.

Referring to FIG. 2, an I/O interface 17 provides connections between the controller 11, the sheet feeder 20 and the image recorder 30, and the engine controller 12 so as to allow various types of information to be exchanged between them. A D-A converter 18 and an A-D converter 19 convert digital signals into analog signals and converts analog signals into digital signals to allow processing of each of the various types of information that the engine controller 12 exchanges with the controller 11, the sheet feeder 20, and the image recorder 30.

The sheet feeder 20 is constituted by a sheet cassette 21, a sheet discharge table 22, a pickup roller 23, a transport roller pair 24, a registration roller pair 25, a switching roller pair 26, a sheet discharge roller pair 27, reversal roller pairs 28 and 29, an intermediate transfer belt 34 which also serves as a constituent element of the image recorder 30, a transfer roller 35, and a fixing roller pair 36. The sheet feeder 20 separates one sheet at a time from a plurality of sheets of recording paper placed in the sheet cassette 21 and transports it to an image recording or forming position P of the image recorder 30. After received image data such as characters are recorded or formed on one side or both sides of the sheet of recording paper, the sheet feeder transports the recording paper having an image formed thereon out of the device and places it on the sheet discharge table 22.

Briefly, the pickup roller 23 rotates while being pressed against the sheets of recording paper which are placed on an elevating plate 21*a* in the sheet cassette 21, and the roller thus pulls out and separates the recording paper one sheet at a time in cooperation with separating means which is not shown and feeds the sheet into a feeding path f. The transport roller pair 24 sandwiches and transports the sheet of recording paper and puts the leading end of the sheet in abutment with a nip between the pair of registration rollers 25 located downstream thereof to correct any skew of the sheet. The registration roller pair 25 sandwiches and feeds the sheet to the image recording or forming position P in synchronism with the operation of the image recorder 30.

In the image recording or forming position P, the intermediate transfer belt 34 and the transfer roller 35 transport the recording paper thus fed by rotating while sandwiching the paper and record or form an image on one side of the same. The fixing roller pair 36 rotates while sandwiching the recording paper to transport it downstream and fixes the image on the recording paper.

Thereafter, the switching roller pair 26 and the sheet discharge roller pair 27 transport the recording paper from the fixing roller 36 to place it on the discharge sheet table 22. Thus, the sheet of recording paper is fed to the position P where an image is recorded or formed by the image recorder 30 on one side of the same as an image recording or forming surface, and the recording paper is discharged onto the sheet discharge table 22 after the image is formed on one side thereof.

When the engine controller 12 is instructed to perform recording in a two-side mode in which images are to be formed on both sides of the recording paper, the sheet discharge roller pair 27 temporarily stops in a position where it sandwiches the rear end of the sheet of recording paper which has been transported onto the sheet discharge table 22. The roller pair 27 is thereafter reversed along with the switching roller pair 26 to deliver the sheet of recording paper having an image recorded or formed on one side thereof to a reverse path r.

Thereafter, the reverse roller pairs 28 and 29 sandwich the recording paper to feed the paper into the reverse path r and transport it in the path, whereby the sheet of recording paper is fed to the feeding path f again to be passed to the registration roller pair 25, the sheet being fed with their sides reversed and fed from the end thereof which was the rear end when an image was formed on one side thereof. As a result, the recording paper is fed to the image recording or forming position P of the image recorder 30 with the other side thereof (the side on which no image has been recorded or formed) serving as an image recording or forming surface. The recording paper is discharged onto the sheet discharge table 22 after images are thus formed on both sides thereof.

The image recorder 30 has an exposure unit 31, a photosensitive member cartridge 32, a development rotary unit 33, an intermediate transfer belt 34, a transfer roller 35, and a fixing roller pair 36. The image recorder 30 performs electrophotographic recording or formation of received image data such as characters on one side or both sides of a sheet of recording paper which has been fed by the sheet feeder 20 to the image recording or forming position P.

Briefly, the exposure unit 31 performs an exposure scan by selectively irradiating a surface of a photosensitive drum 32*a* in the photosensitive member cartridge 32 with laser light based on image data received by a laser light scanner (polygon mirror) 31*a* incorporated therein. Thus, an electrostatic latent image based on the image data is formed (imaged) on the surface of the photosensitive drum 32*a*. The development rotary unit 33 contains development cartridges 37 (represented by 37*y*, 37*m*, 37*c*, and 37*k* in the figure) for developing the electrostatic latent image on the photosensitive drum 32*a* using toners in respective colors, i.e., yellow (Y), magenta (M), cyan (C), and black (K). The unit 33 causes the development cartridges 37 to face the photosensitive drum 32*a* to apply the toners contained therein according to the image data from which an electrostatic latent image is to be formed, thereby developing the electrostatic latent image using the toners.

For example, in the case of a monochrome image using white and black (hereinafter simply referred to as a monochrome image), the intermediate transfer belt 34 receives a toner image formed on the photosensitive drum 32*a* using a black (K) toner and holds the toner image which is to be transferred onto recording paper on a surface thereof. In the case of a color image, the intermediate transfer belt 34 sequentially receives toner images formed on the photosensitive drum 32*a* using toners in yellow (Y), cyan (C), and magenta (M) such that the images overlap each other (the order of the colors is not limiting the invention) and forms and holds the toner images which are to be transferred onto recording paper on a surface thereof. The transfer roller 35 is pressed against recording paper which has been fed to the gap (the image recording or forming position P) between itself and the intermediate transfer belt 34 to nip it from both sides thereof and transports the sheet thus sandwiched, thereby transferring the toner images onto the recording paper. That is, the first embodiment employs a method of transfer in which the intermediate transfer belt 34 serves as a mediator for the transfer of toner images onto recording paper. Obviously, the toners transfer from the development cartridges 37 to the recording paper through the photosensitive drum 32*a* and the intermediate transfer belt 34 according to bias voltages between those members.

The fixing roller pair 36 is pressed against the recording paper having the toner image transferred thereon fed from the image recording or forming position P while applying heat to the same. The roller pair 36 thus fixes the toner image and transports the recording paper downstream while sandwiching the same. Thus, a monochrome image or color image is recorded or formed (fixed) on one side or both sides of the recording paper based on the received image data, and images can be continuously recorded or formed on a plurality of sheets of recording paper by repeating such operations.

After the transfer from the photosensitive drum 32*a* to the intermediate transfer belt 34, any residual toner on the drum is subjected to charge removal and collected by a cleaner (not shown). The drum is thereafter charged by a charger to a potential at which toners are received from and applied by the development cartridges 37 of the development rotary unit 33. The intermediate transfer belt 34 is similarly discharged and charged to allow the transfer (application) and collection of toners to be repeated. Further, any toner which has scattered during the collection is caught by a filter 39*a* attached to an exhaust duct 39 as a result of suction from the apparatus main body performed by a suction fan 38 through the exhaust duct 39.

Figure 3:
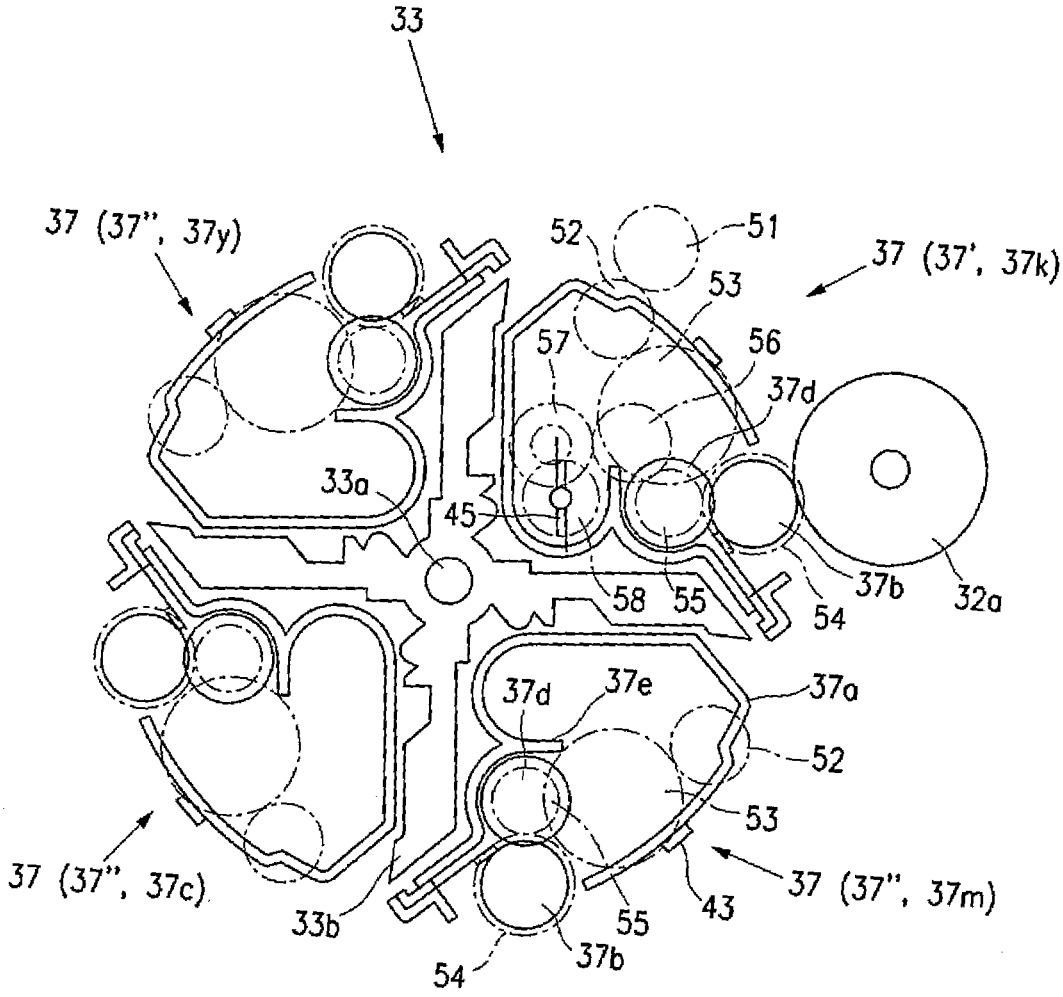
FIG. 3 is a perspective front view of a development rotary unit accommodating a development cartridge of the apparatus.

As shown in FIG. 3, the development rotary unit 33 is formed by accommodating (mounting) the plurality of development cartridges 37 for developing an electrostatic latent image on the photosensitive drum 32*a* using toners in accommodating positions defined by a partition frame 33 which rotates around a rotary shaft 33*a*. The development rotary unit 33 rotates around the rotary shaft 33*a* based on a print command including image data from the personal computer PC which has been received by the CPU (control unit) 13 of the engine controller 12 through the controller 11. Thus, the development cartridges 37 are switched so as to face the photosensitive drum 32*a* one after another to develop a toner image which is to be transferred onto one side or both sides of recording paper to form an image thereon.

In the first embodiment, there are two types of development cartridges 37 which are categorized by basic configuration, i.e., first development cartridges 37' incorporating a conditioning fin 45 as toner conditioner as will be described later and second development cartridges 37" incorporating a partition plate 37*e* instead of the conditioning fin to agitate a toner contained therein utilizing the rotation of the development cartridges themselves caused by the rotation of the rotary unit (hereinafter, when a development cartridge is simply referred to as a development cartridge 37, it is not intended to specify the cartridge as either of the first and second types).

For example, in the image forming apparatus, development cartridges 37*y*, 37*m*, 37*c*, and 37*k* containing toners in respective colors, i.e., yellow (Y), magenta (M), cyan (C), and black (K) are accommodated in the development rotary unit 33, and the development rotary unit 33 is rotated to switch the development cartridges 37 for developing an electrostatic latent image on the photosensitive drum 32*a* such that the toners in various colors contained therein to be applied in an overlapping relationship or in a selective manner, which allows the apparatus to be used as an apparatus capable of forming color images and single-color images.

Specifically, a development cartridge 37 (which corresponds to the second development cartridge 37" in this specification) has a container 37*a*, a development roller 37*b*, a supply roller 37*d*, and a partition plate 37*e*. The container 37*a* is formed in a shape similar to each accommodating space (position) defined by the partition frame 33*b* of the development rotary unit 33 such that it can be accommodated in the space, the container containing a toner. The development roller 37*b* is rotatably carried on the outer circumferential side of the container 37*a* apart from the rotary shaft 33*a* of the development rotary unit 33, and the roller applies the toner supplied from the supply roller 37*d* to the photosensitive drum 32*a* facing the same. The supply roller 37*d* is rotatably carried in the container 37*a* such that it adjoins the side of the development roller 37*b* toward the rotary shaft 33*a* of the development rotary unit 33, and the roller rotates while being pressed against the development roller 37*b* to supply the toner around the same to the development roller 37*b* by causing frictional charging of the toner. The partition plate 37*e* is provided so as to surround the supply roller 37*d* to partition the toner containing space in the container 37*a* such that the space on the rotary shaft 33*a*'s side of the plate and the space where the supply roller 37*d* is provided are in communication with each other in upper parts thereof as viewed in the rotating direction.

In the second development cartridge 37" having such a configuration, the toner in the space on the outer circumferential side of the container 37*a* partitioned by the partition plate 37*e* is supplied to the development roller 37*b* against which the supply roller 37*d* is pressed while being rotated. When the development cartridge 37" is rotated at 180 deg as a result of rotations of the development rotary unit 33 at 90 deg at a time, the portions of the toner contained on the side of the rotary shaft 33*a* and on the side of the supply roller 37*d* in the container 37*a* are mixed above the partition plate 37*e* (as shown in the lower part of FIG. 3). The cartridge is further rotated at 90 deg at a time to agitate and refresh the toner contained in the container 37*a* and to collect the contained toner toward the supply roller 37*d* such that it can be supplied to the development roller 37*b*. That is, in the development cartridge 37" mounted in the development rotary unit 33 which rotates as thus described, the toner contained therein is supplied to the supply roller 37*d* while being agitated as a result of the rotation. It is therefore possible to eliminate any conditioning device (so-called agitator or auger) for performing a conditioning operation to agitate and re-supply the contained toner, if appropriate. However, when a conditioning device is eliminated from the development cartridge 37, it is necessary to perform a toner re-supplying and agitating operation by rotating the development rotary unit 33 at least before the toner to be supplied to the development roller 37*b* runs out around the supply roller 37*d*, e.g., when the amount of the toner used exceeds a preset value as a result of detection from a count value in a toner counter, the number of dots of images, a cumulative time of developing operations (image formation), a cumulative number of sheets developed, or a measured amount of remaining toner.

Each of the development cartridges 37 incorporates a non-volatile memory 42 and a developing-side connector 43, and a control-side connector 44 is provided at the development rotary unit 33. Identification information such as a serial number and various types of information such as the color, the date of manufacture, and the amount consumed of the contained toner are rewritably stored in the non-volatile memory 42. The developing-side connector 43 is connected to the respective non-volatile memory 42 to allow reading and rewriting of the information stored therein. The control-side connector 44 is immovably provided at the outer periphery of the development rotary unit 33 to exchange various types of information on a contact communication or a non-contact communication basis when it faces the developing-side connector 43 of a development cartridge 37. As a result, the engine controller 12 of the control unit 10 can recognize the presence and position of a development cartridge 37 accommodated in an accommodating position of the development rotary unit 33 and can have various type of information such as information on the color of the toner in the development cartridge 37.

In the development cartridges 37 and the development rotary unit 33, the toners contained therein can be agitated and re-supplied (conditioned) when the development rotary unit 33 rotates to select the toner in each color in the accommodating positions of the development cartridges 37*y*, 37*m*, and 37*c* containing the toners in the respective colors, i.e., yellow (Y), magenta (M), and cyan (C) for forming a color image. Therefore, the development rollers 37*b* and the supply rollers 37*d* incorporated are driven for rotation without agitator or auger. Referring to the development cartridge 37*k* containing a black (K) toner for forming a monochrome image, the cartridge has the configuration of the first development cartridge 37' in the present specification because it may continuously form an image such as a text. Specifically, the cartridge has the conditioning fin device (conditioner) acting as an agitator or auger to agitate and re-supply the toner contained therein without rotating the development rotary unit 33. The conditioning fin 45 is driven for rotation along with the development roller 37*b* and the supply roller 37*d* incorporated in the cartridge to agitate and re-supply the contained toner.

Briefly, in the positions where the second development cartridges 37" according to the present specification or development cartridges 37*y*, 37*m*, and 37*c* are accommodated, the development roller 37*b* and the supply roller 37*d* are rotated and operated by a gear train configured by engaging and linking a development-driving main body gear 51, a development-driving rotary gear 52, a development-driving transmission gear 53, a development roller gear 54, and a supply roller gear 55 with each other. The development roller 37*b* is driven by a rotation of the development roller gear 54 caused by a driving force transmitted through the gears 51 to 53 from a development-driving motor (driving source) (not shown) which is driven according to a control signal from the engine controller 12. The supply roller 37*d* is driven by a rotation of the supply roller gear 55 which engages the development roller gear 54.

In the position where the first development cartridge 37' according to the present specification or development cartridge 37*k* is accommodated, the conditioning fin 45 is rotated and operated by a gear train formed by engaging and linking a drive-relaying gear 56, an adjustment-driving transmission gear 57, and a conditioning fin gear 58 with each other in addition to gears 51 to 55 configured as a gear train similar to that described above. At the same time when the driving force from the development-driving motor is transmitted through the gears 51 to 55 to drive the development roller 37*b* and the supply roller 37*d* for rotation, the conditioning fin 45 is driven as the conditioning fin gear 58 is rotated through the gears 56 and 57 which are engaged with the supply roller gear 55.

The development rotary unit 33 is mounted on a rotary frame 33*c* (shown in FIGS. 4A and 4B) which rotates around the rotary shaft 33*a*, and the unit sequentially moves the development cartridges 37 mounted therein to the developing position facing the photosensitive drum 32*a* when the rotary frame 33*c* is rotated by a driving force from a rotary drive motor which is similarly driven according to a control signal from the engine controller 12.

Specifically, the development-driving transmission gear 53, the development roller gear 54, and the supply roller gear 55 are provided in each development cartridge 37, and four sets of the gears are mounted in total. The roller gears 54 and 55 are coaxially secured to one end of the respective rollers 37*b* and 37*d* and are rotatably pivoted on the container 37*a* in engagement with each other. The development-driving transmission gear 53 is rotatably pivoted on the container 37*a* in engagement with the development roller gear 54. One set of the drive-relaying gear 56, the adjustment-driving transmission gear 57, and the conditioning fin gear 58 is provided in the development cartridge 37*k* which is a first development cartridge 37'. Similarly, the conditioning fin gear 58 is coaxially secured to one end of the conditioning fin 45 and is rotatably pivoted on the container 37*a*. The drive-relaying gear 56 is engaged with the supply roller gear 55, and the adjustment-driving transmission gear 57 is rotatably pivoted on the container 37*a* in engagement with the drive-relaying gear 56.

The development-driving main body gear 51 and the development-driving rotary gear 52 are provided in the development rotary unit 33. Four sets of the development-driving rotary gears 52 are mounted in total in association with the accommodating positions of the respective development cartridges 37 mounted in the development rotary unit 33. The gears 52 are rotatably pivoted on the rotary frame 33*c* rotating integrally with the development rotary unit 33 such that they can be engaged with the development-driving transmission gears 53 of the respective development cartridges 37 which are inserted and removed. Although not shown, one development-driving main body gear 51 is mounted in association with the development-driving motor and is engaged with a motor pinion of the development-driving motor. The development-driving main body gear 51 is rotatably pivoted on a main body frame 59 (shown in FIG. 5) in a position where it engages a development-driving rotary gear 52 when the gear 52 rotates toward the same. The gear 51 is linked through the development-driving rotary gear 52 to the development roller gear 54 and the development-driving transmission gear 53 of the development cartridge 37 to be operated, whereby a gear train serving as a transmission path for transmitting the driving force of the development-driving motor is formed.

Figure 4A:
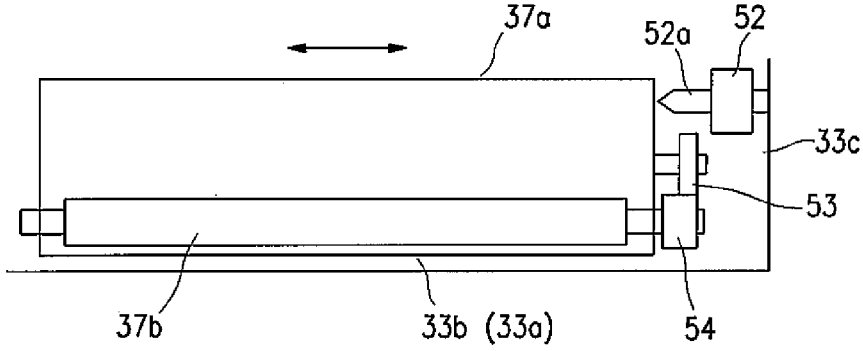
FIGS. 4A and 4B are illustrations of insertion and removal of the development cartridge in and from the development rotary unit.
Figure 4B:
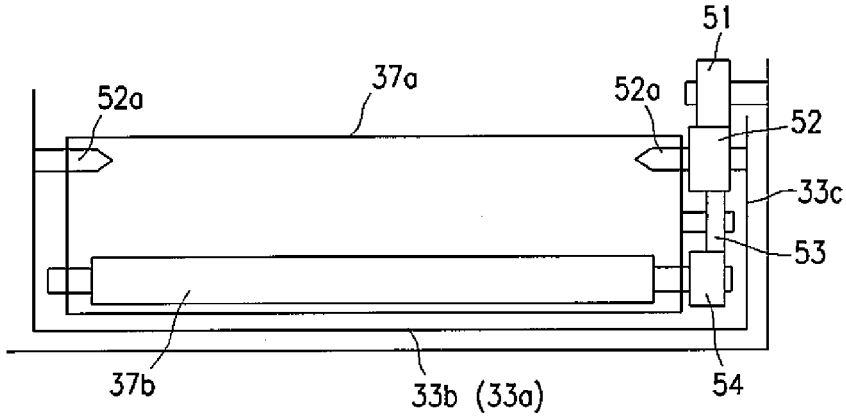

Thus, as shown in FIGS. 4A and 4B, when a development cartridge 37 is replaced, the development roller gear 54 and so on disposed in the development cartridge 37 are removed from the development rotary unit 33 to be replaced together. Referring to the mounting of the development cartridge 37 in the development rotary unit 33, as shown in FIG. 4B, both end faces of the container 37*a* are swingably carried on a carry shaft 52*a* that is coaxial with the rotary shaft of the development-driving rotary gear 52 at the rotary frame 33*c* and is urged in one direction to engage and link the development-driving transmission gear 53 with the development-driving rotary gear 52.

Figure 5:
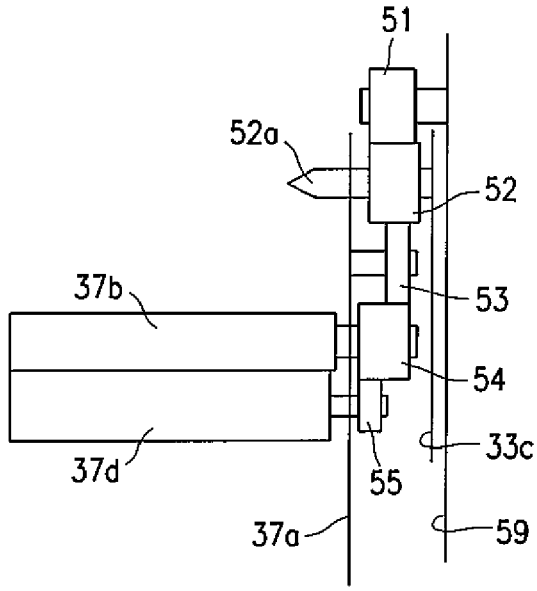
FIG. 5 is a development showing transmission of a driving force to the development cartridge.
Figure 6:
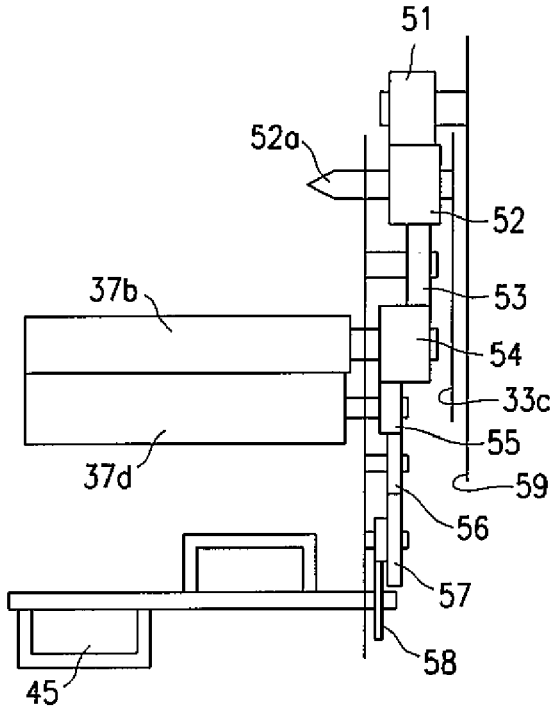
FIG. 6 is a development showing transmission of a driving force to a development cartridge different from that in FIG. 5.

Therefore, in the case of the second development cartridges 37" according to the invention or the development cartridges 37*y*, 37*m*, and 37*c* which do not have the conditioning fin 45, the development-driving rotary gear 52 engages the development-driving main body gear 51 in the developing position to form a gear train (transmission path) for transmitting the driving force of the development-driving motor which drives the development roller 37*b* and the supply roller 37*d* for rotation through the gears 51 to 55 shown in FIG. 5. In the case of the first development cartridge 37, or the development cartridge 37*k* having the conditioning fin 45, the development-driving rotary gear 52 engages the development-driving main body gear 51 in the developing position to form a gear train (transmission path) for transmitting the driving force of the development-driving motor which drives the conditioning fin 45 for rotation along with the development roller 37*b* and the supply roller 37*d* through the gears 51 to 58 shown in FIG. 6. That is, the conditioning fin 45 is driven for rotation using a driving source that is commonly used for the development roller 37*b* and the supply roller 37*d*. The development-driving main body gear 51 incorporates a one-way clutch so that it undergoes idle running in the reverse rotating direction of the development roller 37*b*. As a result, the gear 51 can escape from engagement with the development-driving rotary gear 52 that is rotating to avoid damage on the tooth tops of each other attributable to a collision between them. FIGS. 5 and 6 do not show an actual positional relationship between the gear trains but show engagements between them.

The torque required for the driving of the development-driving rotary gear 52 by the development-driving main body gear 51 varies depending on whether the development cartridge 37 has the conditioning fin 45 or not. Therefore, the torque supplied from development-driving motor to the development-driving main body gear 51 may be varied depending on the development-driving rotary gear 52 in engagement with the motor.

That is, although the development-driving rotary gears 52 are identical in configuration, driving torque for the first development cartridge 37' having the conditioning fin 45 is different from driving torque supplied to the development-driving rotary gear 52 of the second development cartridge 37" which does not have the conditioning fin 45.

As will be described later, the CPU 13 executes control over the agitation of the toner in a development cartridge contained as occasions demand based on information on the development cartridge. At this time, the CPU 13 may be provided with the knowledge of the type of the development cartridge contained by detecting the torque required for driving the same as described above.

In the image forming apparatus of the first embodiment, the development rotary unit 33 has a configuration in which all of the development cartridges 37 can contain toners in the same color to form an image. For example, development cartridges 37K which can be accommodated in the positions for accommodating the development cartridges 37*y*, 37*m*, and 37*c* that are the second development cartridges 37" without the conditioning fin 45 may be mounted while filling it with a toner in black (K) that is the same color as in the development cartridge 37*k*. In this case, the development rotary unit 33 may be rotated to sequentially switch the development cartridges 37*k* as the first development cartridge 37' and the development cartridges 37K for developing an electrostatic latent image on the photosensitive drum 32*a*, thereby allowing the apparatus to be used as a machine dedicated for the formation of a monochrome image. For example, the development cartridges 37*k* and 37K may be appropriately switched according to received image data to perform an image forming operation in a comfortable manner. The development rotary unit 33 may be used as a device that allows formation of a multi-color image or single-color image in which the toner in each color is separately used by replacing some of the development cartridges 37*y*, 37*m*, and 37*c* with a development cartridge 37K.

After the power supply is turned on, the CPU 13 of the engine controller 12 executes various control operations according to control programs in the ROM 14. When the power supply is turned on or when a development cartridge 37 is replaced, the CPU performs non-contact communication through the connectors 43 and 44 to maintain (store) information on the presence or absence of the development cartridges 37 in their accommodating positions in the development rotary unit 33 in the main body memory 15. The CPU 13 also sequentially reads various types of information written in the non-volatile memory 42 of each development cartridge 37 through the connectors 43 and 44 to maintain information on the position of each development cartridge 37, the presence or absence of the conditioning fin 45 in the same (determination of the type of the development cartridge) and information on the color and consumption (remaining amount) of the toner in the main body memory 15. Further, during or after an image forming operation, the CPU 13 rewrites the non-volatile memory 42 of each development cartridge 37 by writing various types of information such as the amount of the toner consumed to form the image in the memory through the connectors 43 and 44. That is, the CPU 13 constitutes an identification unit as well as control unit. Mechanical limitations may be put on the positions to accommodate the development cartridges 37*y*, 37*m*, and 37*c* mounted in the development rotary unit 33 because there is an optimum order for overlapping the colors when a color image is formed. In this case, an arrangement may be made to allow the development cartridge 37*k* to be accommodated free of such limitations.

In such a case, when the CPU 13 knows that the development cartridges 37*y*, 37*m*, 37*c*, and 37*k* containing toners in the respective colors, i.e., yellow (Y), magenta (M), cyan (C), and black (K) are set in the development rotary unit 33, the CPU executes image formation control in a common manner to rotate the development rotary unit 33 according to image data sent from the controller 11, thereby recording or forming a color image, multi-color image or single-color image on one side or both sides of recording paper. In other words, the development cartridges 37 for the respective colors mounted in the development rotary unit 33 operate while being appropriately switched each time an instruction for printing of image data is received according to the type of the image that is based on the image data. Thus, in the development cartridges 37*y*, 37*m*, and 37*c*, as the development rotary unit 33 rotates, the toners contained are appropriately supplied to the supply rollers 37*d* which supply the toners to the development rollers 37*b*. Meanwhile, the development cartridge 37*k* for developing a toner image of a monochrome image continues the image forming operation without being rotated by the development rotary unit 33. Therefore, in the developing position facing the photosensitive drum 32*a*, the conditioning fin 45 is driven for rotation as well as the development roller 37*b* to agitate and re-supply the contained toner to the supply roller 37*d*.

When the CPU 13 knows that the development cartridge 37K that is the second development cartridge 37" has been set in the development rotary unit 33 such that it can be used as a development cartridge to contain the black (K) toner in addition to the development cartridge 37*k* that is the first development cartridge 37', the CPU executes imaging control such that either of the development cartridges containing the black (K) toner is operated.

In the first embodiment, image formation control is executed so as to operate the development cartridge 37K that is the second development cartridge 37" with priority except under predetermined conditions, whereby a monochrome image according to image data sent from the controller 11 is recorded or formed on one side or both sides of recording paper.

Figure 7:
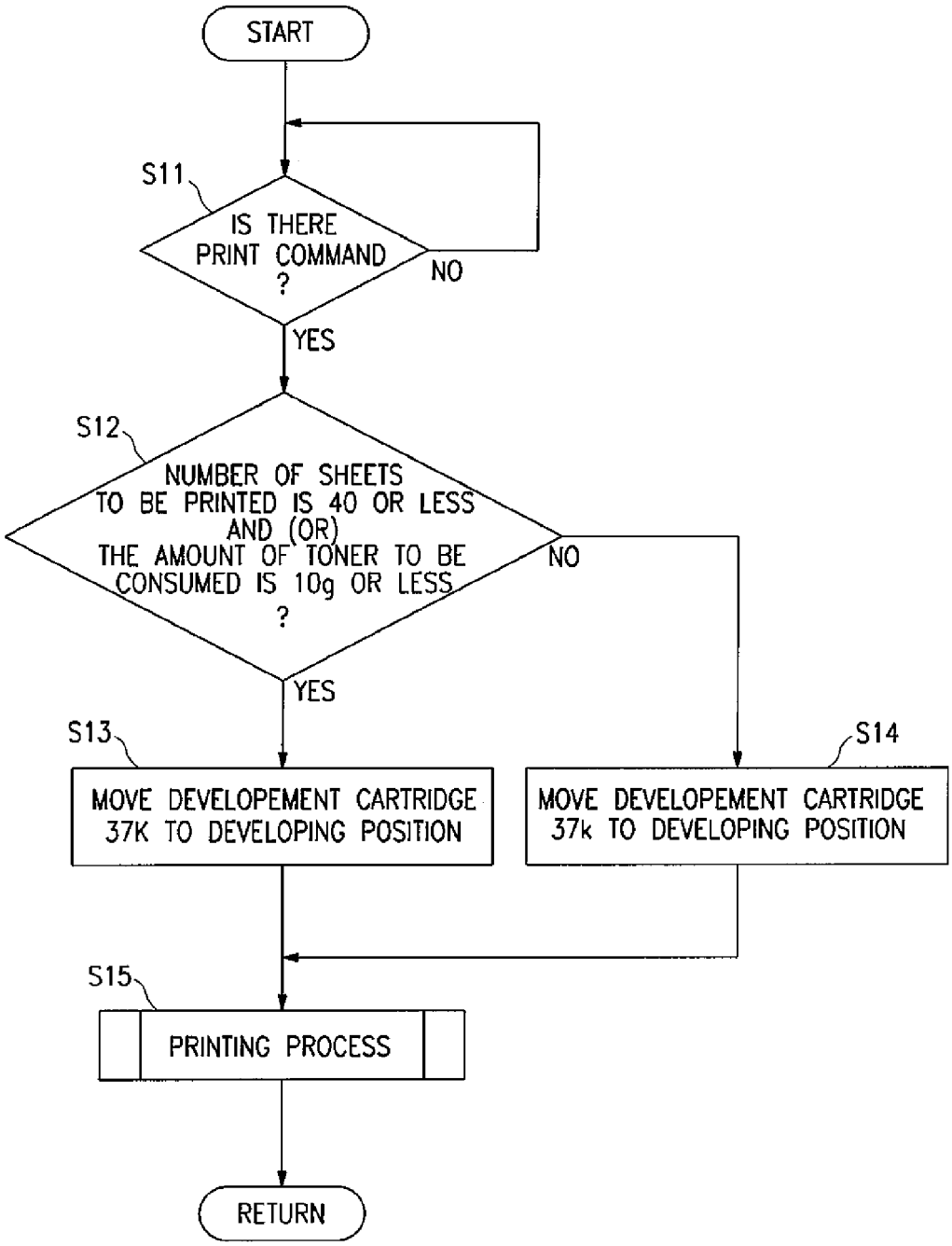
FIG. 7 is a flow chart for explaining image formation control.

Specifically, as shown in the flow chart in FIG. 7, when an instruction for printing of image data of a monochrome image is received from the controller 11 (step S11), it is checked whether or not an image forming operation based on the image data can be completed without performing an operation of replenishing the supply roller 37*d* with the toner contained in the development cartridge 37K, e.g., whether the number of sheets to be printed is 40 or less and (AND) the amount of toner to be consumed identified based on the number of dots of images is 10 g or less provided that A4 recording paper is used (step S12). Although the determination is made using AND which asks if both of the conditions are satisfied in the first embodiment, it is obvious that the invention is not limited to the same, and the determination may be made using OR which asks if either of the conditions is satisfied.

Figure 8:
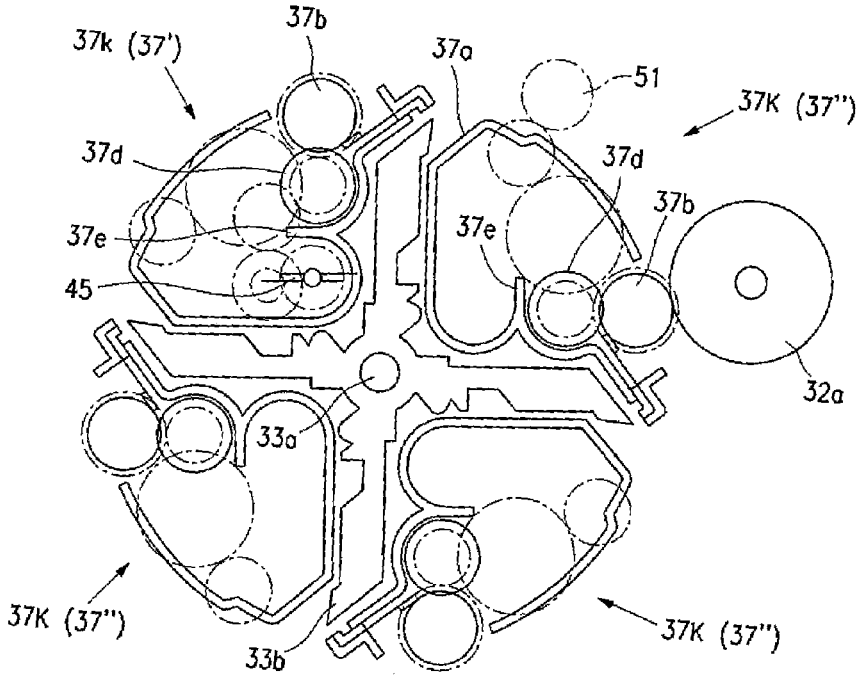
FIG. 8 is a perspective front view of the development rotary unit as an example for explaining switching of development cartridges.

When the image formation based on the received image data satisfies both of the conditions, as shown in FIG. 8, the development cartridge 37K is moved to the developing position facing the photosensitive drum 32*a* (step S13). If either of the conditions is not satisfied, as shown in FIG. 3, the development cartridge 37*k* is moved to the developing position (step S14). Thereafter, control over driving of the sheet feeder 20 and the image recorder 30 is executed to print the received image data, thereby recording or forming an image on one side or both sides of the recording paper (step S15).

Thus, the CPU 13 automatically recognizes the development cartridges 37*k* and 37K mounted in the development rotary unit 33 and appropriately uses them according to the image data without any need for an operator to perform a setting operation on an operation panel. As a result, the process of printing the received image data can be completed in a comfortable manner without rotating the development rotary unit 33 during the operation of forming an image from the image data (without any interruption of the image forming operation attributable to the rotation of the development rotary unit 33).

The development rotary unit 33 may be loaded with the development cartridge 37K having no conditioning fin 45 and containing a black (K) toner in addition to the development cartridge 37*k* having a conditioning fin 45 and containing a black (K) toner, and it is therefore possible to mount a greater number of development cartridges 37 for forming a monochrome image. That is, the amount of a black (K) toner contained for forming monochrome images can be increased to print images in an amount greater than that achievable using only the development cartridge 37*k*.

In a case wherein the development cartridge 37K is in the developing position and is processing image data which have been previously received when the CPU 13 is to start an image forming operation, the CPU subtracts amounts associated with the process from the preset number of sheets to be printed and the preset amount of consumption to determine whether the image data do not necessitate an operation of replenishing the supply roller 37*d* with the toner. When the toner in the development cartridge 37*k* runs out, it is obvious that the CPU causes the development cartridge 37K to move to the developing position and repeats the operation of agitating and re-supplying the contained toner utilizing the rotation of the development rotary unit 33 as occasion demands to continue the operation of forming a monochrome image.

Specifically, for example, let us assume that the number of sheets printed after the start of printing reaches 40 or (OR) the amount of consumption of the toner identified based on the number of dots of images reaches 10 g provided that A4 recording paper is used. Then, the development rotary unit 33 may be rotated to move another development cartridge 37K contained in the unit to the developing position, or the unit may alternatively be made to make a full turn to continue printing with the same development cartridge 37K positioned again in the developing position. Although the determination in the first embodiment is made using OR that asks either of the conditions is satisfied, it is obvious that the invention is not limited to the same, and the determination may be made using AND that asks whether both of the conditions are satisfied.

Figure 9:
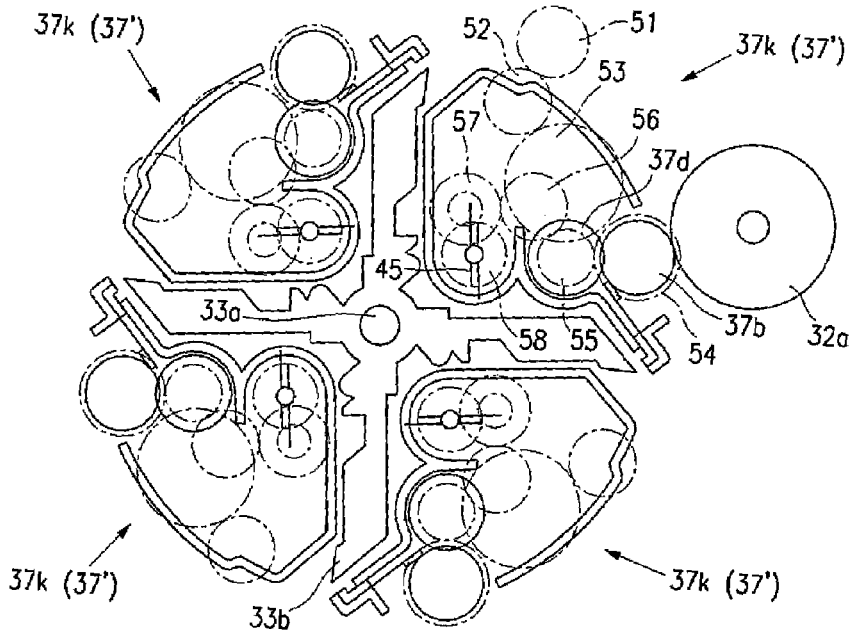
FIG. 9 is a perspective front view of a development rotary unit showing a modified example of the first embodiment according to the invention.

Further, as shown in FIG. 9, the development rotary unit 33 may be made to allow development cartridges 37*k* having the conditioning fin 45 and containing a black (K) toner to be mounted in all of the accommodating positions, and what is then required is that the CPU 13 executes control over image formation including the rotation of the development rotary unit 33 based on automatic recognition of the cartridges. In this case, since the gears 51 to 58 are engaged such that the conditioning fins 45 can be driven for rotation even when the development cartridges 37*k* are accommodated in the positions for accommodating the development cartridges 37*y*, 37*m*, and 37*c* in the development rotary unit 33 of the first embodiment, each of the cartridges can continue an image forming operation without being rotated by the development rotary unit 33. For example, it is therefore possible to switch the development cartridge 37*k* located in the developing position sequentially each time the toner runs out or to switch the development cartridges 37*k* each time a received printing instruction is processed. In this case, however, the amount of the toner contained decreases because the conditioning fins 45 are incorporated. For this reason, it is preferable to use the development cartridges 37*k* and 37K in an appropriate combination according to the purpose of use. For example, management may be simplified using only the development cartridges 37*k* having the conditioning fin 45, or priority may be given to increasing the amount of images formed through an increase in the amount of the contained toner achieved by providing both cartridges.

Specifically, for example, a development cartridge 37*k* having the conditioning fin 45 can form images on about 5,500 sheets of A4 recording paper when it contains 230 g of black (K) toner and prints dots in 5% of an image recording surface. On the contrary, a development cartridge 37K having no conditioning fin 45 can contain 250 g of black (K) toner because it is free from any reduction in the containing amount attributable to mechanical parts such as the conditioning fin 45 and hindrance on the fluidity of the toner. Thus, the cartridge can form images on about 6,000 sheets of A4 recording paper when similar dot printing is performed. As a result, for example, the development rotary unit 33 can continuously print images on 22,000 sheets in total when it is equipped with four development cartridges 37*k*, whereas the unit can continuously print images on 23,500 sheets in total when it is equipped with one development cartridge 37*k* and three development cartridges 37K.

As thus described, the apparatus of the first embodiment can form a color image or single-color image without any special setting operation by automatically recognizing the development cartridges 37 mounted therein and rotating the development rotary unit 33 as occasion demands. In addition to an existing development cartridge 37*k*, the development rotary unit 33 may be equipped with a development cartridge 37*k* or 37K containing a toner in the same color or black (K). In this case, a large amount of monochrome images can be formed on one side or both sides of recording paper without frequently performing a toner re-supplying operation through replacement of the development cartridges 37. The development cartridges 37*k* and 37K may be mounted in the development rotary unit 33 according to the convenience of the user considering how frequently color images and single-color images are formed.

Second Embodiment

Figure 10:
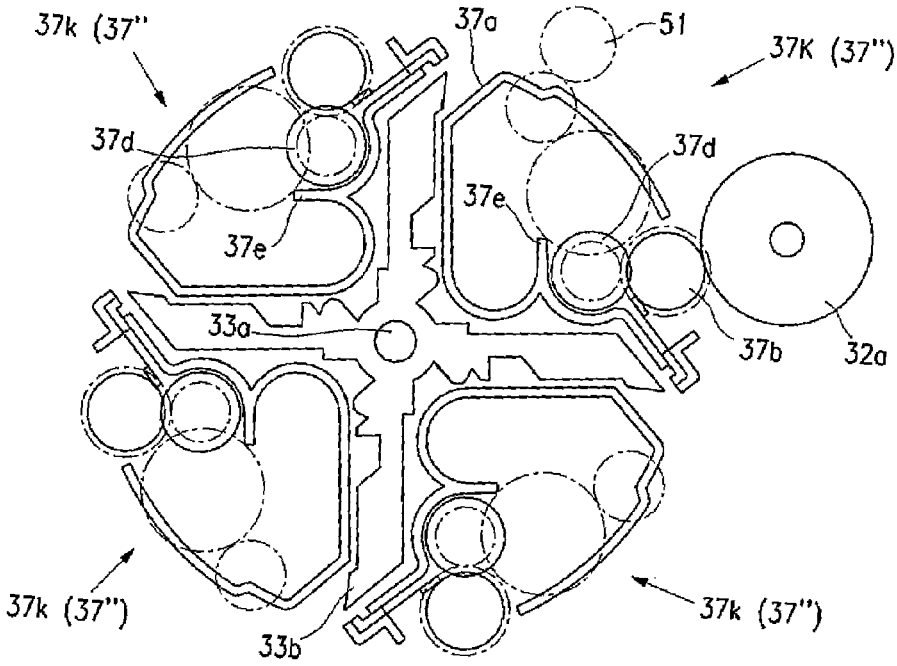
FIG. 10 is a perspective front view of the development rotary unit with development cartridges containing toners in the same color mounted therein according to the second embodiment.
Figure 11:
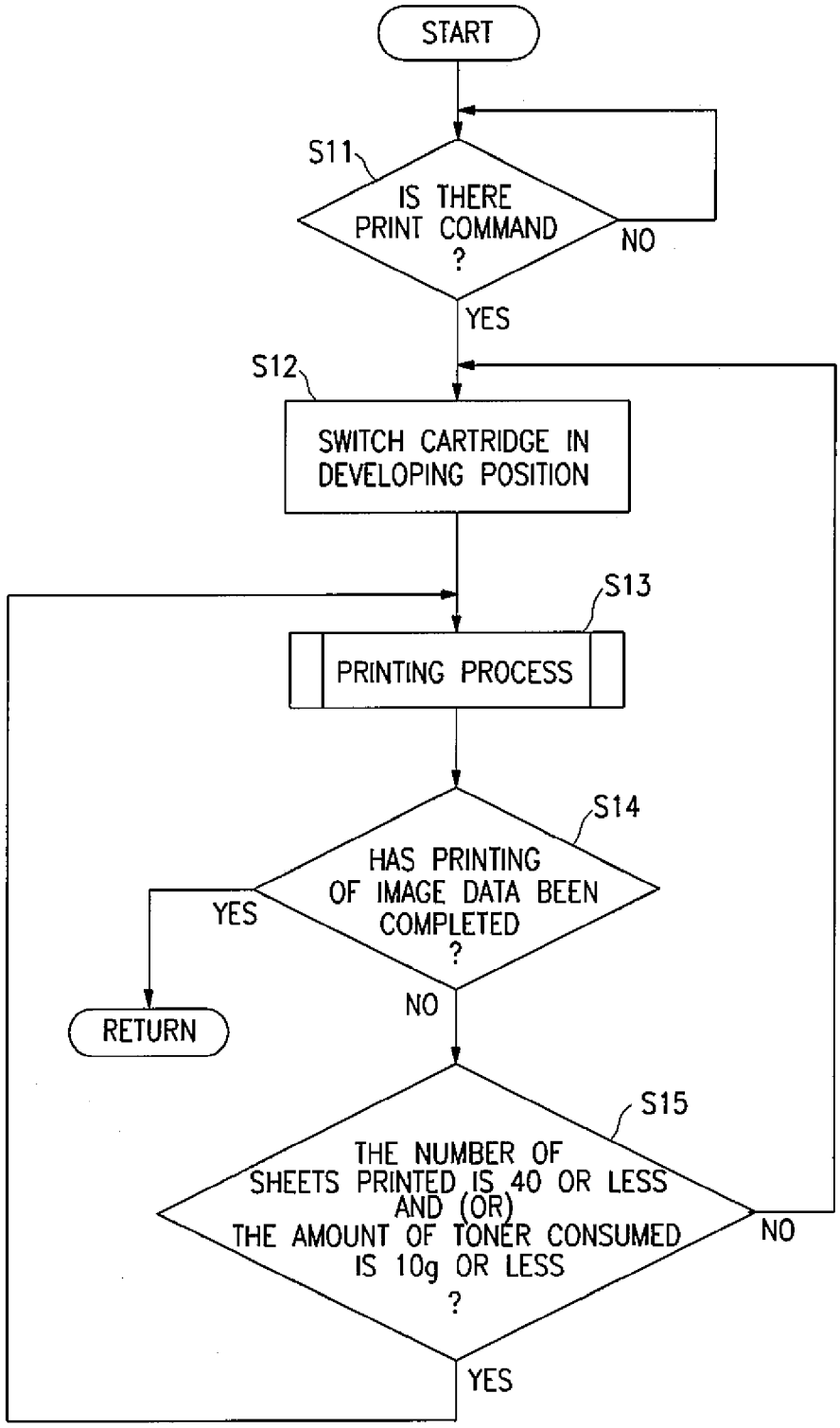
FIG. 11 is a flow chart for explaining image formation control according to the second embodiment.

Basic structure of the image forming apparatus of the second embodiment is identical to that of the image forming apparatus of the first embodiment. In the drawings, components same as or corresponding to those of the first embodiment are given the same reference numerals. FIG. 10 is a perspective front view of a development rotary unit with development cartridges containing toners in the same color mounted therein according to the second embodiment. FIG. 11 is a flow chart for explaining image formation control according to the second embodiment.

In the image forming apparatus of the second embodiment, the development rotary unit 33 has a configuration in which all of the development cartridges 37 can contain toners in the same color to form an image. For example, development cartridges 37K which can be accommodated in the positions for accommodating the development cartridges 37*y*, 37*m*, and 37*c* or that are the second development cartridges 37" without the conditioning fin 45 may be mounted while filling it with a toner in black (K) that is the same color as in the development cartridge 37*k* that is the first development cartridge 37' and, as shown in FIG. 10, the development cartridges K may be mounted in accommodating positions including the position for the development cartridge 37*k*. In this case, the development rotary unit 33 may be rotated to sequentially switch the development cartridges 37K for developing an electrostatic latent image on the photosensitive drum 32*a*, thereby allowing the apparatus to be used as a machine dedicated for the formation of a monochrome image. Incidentally, as shown in FIG. 8, the development rotary unit 33 may be used as a device that allows formation of a multi-color image or single-color image in which the toner in each color is separately used by replacing all or some of the development cartridges 37*y*, 37*m*, and 37*c* with a development cartridge 37K while leaving the development cartridge 37*k* mounted as it is.

Specifically, after the power supply is turned on, the CPU 13 of the engine controller 12 executes various control operations according to control programs in the ROM 14. When the power supply is turned on or when a development cartridge 37 is replaced, the CPU performs non-contact communication through the connectors 43 and 44 to maintain (store) information on the presence or absence of the development cartridges 37 in their accommodating positions in the development rotary unit 33 in the main body memory 15. The CPU 13 also sequentially reads various types of information written in the non-volatile memory 42 of each development cartridge 37 through the connectors 43 and 44 to maintain information on the position of each development cartridge 37, the presence or absence of the conditioning fin 45 in the same (determination of the type of the development cartridge), and information on the color and consumption (remaining amount) of the toner in the main body memory 15. Further, during or after an image forming operation, the CPU 13 rewrites the non-volatile memory 42 of each development cartridge 37 by writing various types of information such as the amount of the toner consumed to form the image in the memory through the connectors 43 and 44. That is, the CPU 13 constitutes an identification unit as well as control unit. Mechanical limitations may be put on the positions to accommodate the development cartridges 37*y*, 37*m*, and 37*c* mounted in the development rotary unit 33 because there is an optimum order for overlapping the colors when a color image is formed. In this case, an arrangement may be made to allow the development cartridge 37*k* to be accommodated free of such limitations.

A single-color image can be formed with the image forming apparatus of the present invention by accommodating development cartridges 37K without the conditioning fin 45 containing black (K) toners (which therefore correspond to the second development cartridge 37") in the development rotary unit 33 instead of the development cartridges 37*y*, 37*m*, 37*c*, and 37*k*.

In this case, the CPU 13 knows that the development cartridges 37" without the conditioning fin 45 containing black (K) toners have been set in the development rotary unit 33 instead of the development cartridges 37*y*, 37*m*, 37*c*, and 37*k*, the CPU executes image formation control for a case in which the development cartridges 37K containing toners in the same color (black (K)) are mounted in all accommodating positions.

Specifically, the development rotary unit 33 is appropriately rotated according to image data sent from the controller 11 to record or form a single-color image on one side or both sides of recording paper.

In this case, since the development cartridges 37*k* have toners in the same color and require the same control over agitation, there is no need for selecting a predetermined one of them as the development cartridge to initiate printing based on the sheet of paper to be printed and the amount of toner to be consumed.

Specifically, as shown in the flow chart in FIG. 11, when an instruction for printing of image data of a monochrome image is received from the controller 11 (step S11), the development rotary unit 33 is rotated to perform cartridge switching by moving the next development cartridge 37K to the developing position facing the photosensitive drum 32*a* (step S12). Thereafter, control over the driving of the sheet feeder 20 and the image recorder 30 for printing the received image data is performed to form an image on one side or both sides of recording paper (step S13).

Each time the printing process on each sheet of recording paper is finished, it is checked whether the printing of the received image data has been completed or not (step S14). If completed, the image formation control is terminated without any further action. If not, it is checked whether an amount of image formation has been exceeded or not, the amount being the limit within which the image forming operation can be completed by continuing to use the same development cartridge 37K without replenishing the space accommodating the supply roller 37*d* with the toner. For example, it is checked whether the number of sheets printed is still 40 or less and (AND) the toner consumption identified based on the number of dots of the images is still 10 g or less provided that recording paper in A4 size is used (step S15). Although the determination is made using AND which asks if both of the conditions to be satisfied in the second embodiment, it is obvious that the invention is not limited to the same, and the determination may be made using OR which asks if either of the conditions is satisfied.

When both of the conditions are satisfied, the process returns to step S13, and the printing process is continued using the same development cartridge 37K without rotating the development rotary unit 33. When either of the conditions is no longer satisfied, and the process of printing the received image data cannot be completed using the same development cartridge 37K, the process returns to step S12 at which a switching operation is performed by rotating the development rotary unit 33 to move the next development cartridge 37K to the developing position. Thereafter, the printing process is continued for the remaining image data. At this time, the operation of switching the development cartridges 37K can be quickly finished because it is only to move the adjacent development cartridge 37K to the developing position. For example, the operation can be finished during an interval between times at which successive sheets of recording paper are fed (a so-called sheet interval), and it therefore results in no reduction in the apparent image forming speed (so-called throughput). Since all of the development cartridges 37K used are the same type without the conditioning fin 45, the printing operation can be continued without changing the mode of control over image formation.

Thus, the development cartridges 37K without the conditioning fin 45 containing black (K) toners can be accommodated in all accommodating positions of the development rotary unit 33, and the development cartridge 37K for monochrome images can be mounted in a greater number. That is, a black (K) toner for forming monochrome images can be contained in a greater amount to form a greater amount of images compared to a case in which only the development cartridge 37K is used. The CPU 13 automatically recognizes the development cartridges 37K mounted in the development rotary unit 33 without requiring an operator to perform a setting operation on an operation panel and causes the development rotary unit 33 to rotate as occasions demand during an image forming operation, thereby allowing color images or a great amount of monochrome images to be formed on recording paper.

Specifically, for example, a development cartridge 37*k* having the conditioning fin 45 can form images on about 5,500 sheets of A4 recording paper when it contains 230 g of black (K) toner and prints dots in 5% of an image recording surface. On the contrary, a development cartridge 37K without the conditioning fin 45 can contain 250 g of black (K) toner because it is free from any reduction in the containing amount attributable to mechanical parts such as the conditioning fin 45 and hindrances on the fluidity of the toner. Thus, the cartridge can form images on about 6,000 sheets of A4 recording paper when similar dot printing is performed. As a result, the development rotary unit 33 can continuously print images on 24,000 sheets in total when it is equipped with four development cartridges 37K.

As thus described, the apparatus of the second embodiment can form a color image or single-color image without any special setting operation by automatically recognizing the development cartridges 37 mounted therein and rotating the development rotary unit 33 as occasions demand. When development cartridges 37K containing toners in the same color or black (K) are mounted in all of the accommodating positions of the development rotary unit 33, a large amount of monochrome images can be formed on one side or both sides of recording paper without frequently performing a toner re-supplying operation through replacement of the development cartridges 37.

While the development cartridges 37K are mounted in all of the accommodating positions of the development rotary unit 33 in the embodiment, this is not limiting the invention.

What is required is a configuration in which the development cartridges 37K without the conditioning fin 45 containing black (K) toners can be accommodated in the rotary unit; the CPU 13 determines whether the contained toners are to be agitated or not based on a print command; and an agitating operation is performed as occasions demand utilizing the rotation of the rotary unit 33. Since such a configuration makes it possible to contain a relatively large amount of toner in a single development cartridge, an advantage can obviously achieved in that a large amount of monochrome images can be formed. In particular, a plurality of the development cartridges 37K without the conditioning fin 45 may be contained, and the cartridge used for development may be switched as occasions demand utilizing the rotation of the rotary unit 33 which is caused for agitation. As a result, a large amount of monochrome images can be formed on one side or both sides of recording paper without frequent toner re-supplying operations.

While embodiments of the invention have been described above, the invention is not limited to the embodiments and may obviously be implemented in a variety of different modes within the scope of the technical ideas behind the invention.

What is claimed is:

1. An image forming apparatus comprising:

a carrying member for carrying a toner image provided by forming an electrostatic latent image on a surface thereof and developing the electrostatic latent image;

a plurality of development cartridges for forming the toner image that is to be transferred onto a surface of a recording medium by applying a toner to the electrostatic latent image on the surface of the carrying member to develop the image;

a rotary unit which accommodates the development cartridges around a rotary shaft and rotates around the rotary shaft to cause one of the development cartridges to face the surface of the carrying member; and a control unit which controls a rotation of the rotary unit and a driving of the development cartridges to form the toner image, the rotary unit is configured to have at least one first accommodating position and at least one second accommodating position so as to be able to accommodate development cartridges containing toners in different colors to allow a formation of a color image, multi-color image, or single-color image;

a conditioner is disposed only in a first development cartridge containing a toner in a color for forming a single-color image to condition the toner contained therein;

an operation of conditioning the contained toner is performed in the other development cartridges, each of which is constituted by a second development cartridge without the conditioner, by turning the second cartridge upside down by a rotation of the rotary unit during an image formation, wherein a toner in the color for single-color image is capable of being contained in the second development cartridges without the conditioner and the second development cartridges are capable of being accommodated in the second accommodating position of the rotary unit; and an identification unit for identifying a development cartridge accommodated in the rotary unit, wherein the control unit controls the rotation of the rotary unit based on information from the identification unit.

2. An image forming apparatus according to claim 1, wherein the first development cartridge is capable of being accommodated in the second accommodating position in the rotary unit.

3. An image forming apparatus according to claim 1, wherein when a plurality of development cartridges containing toners in the color for the single-color image are accommodated in the rotary unit and when the image formation necessitates an operation of conditioning the toners contained in the development cartridges, the control unit starts the image formation so that the first development cartridge is located in a developing position facing the carrying member.

4. An image forming apparatus comprising:

a carrying member for carrying a toner image provided by forming an electrostatic latent image on a surface thereof and developing the electrostatic latent image;

a plurality of development cartridges for forming the toner image that is to be transferred onto a surface of a recording medium by applying a toner to the electrostatic latent image on the surface of the carrying member to develop the image;

a rotary unit which accommodates the development cartridges around a rotary shaft and rotates around the rotary shaft to cause one of the development cartridges to face the surface of the carrying member; and a control unit which controls a rotation of the rotary unit and a driving of the development cartridges to form the toner image;

wherein the rotary unit is configured to have at least one first accommodating position in which a first development cartridge having a conditioner is capable of being accommodated and at least one second accommodating position in which a second development cartridge without the conditioner is capable of being accommodated, so as to be able to accommodate development cartridges containing toners in different colors to allow a formation of a color image, multi-color image, or single-color image, and an operation of conditioning the contained toner is performed in the second development cartridge by turning the second cartridge upside down by a rotation of the rotary unit during an image formation;

wherein the second development cartridge without conditioner is capable of being accommodated in the first accommodating position.

5. An image forming apparatus according to claim 4, wherein second development cartridges containing toners in the color for the single-color image is capable of being accommodated in all accommodating positions.

6. An image forming apparatus according to claim 4, further comprising an identification unit for identifying a development cartridge accommodated in the rotary unit and wherein the control unit controls the rotating operation of the rotary unit based on information from the identification unit.

7. An image forming apparatus according to claim 6, wherein when a plurality of the second development cartridges containing toners in the color for the single-color image are accommodated in the rotary unit and when the image formation necessitates an operation of conditioning the toners contained in the development cartridges, the control unit causes a rotation of the rotary unit to condition the toners contained.

* * * * *